US007438652B2

(12) United States Patent
Kuroda

(10) Patent No.: US 7,438,652 B2
(45) Date of Patent: Oct. 21, 2008

(54) GOLF BALL MARKER

(75) Inventor: Akio Kuroda, Ashiya (JP)

(73) Assignees: SRI Sports Ltd., Kobe-shi (JP); Dunlop Sports Enterprises Ltd., Ashiya-shi (JP)

( * ) Notice: Subject to any disclaimer, the term of this patent is extended or adjusted under 35 U.S.C. 154(b) by 0 days.

(21) Appl. No.: 11/397,630

(22) Filed: Apr. 5, 2006

(65) Prior Publication Data

US 2006/0234813 A1 Oct. 19, 2006

(30) Foreign Application Priority Data

Apr. 19, 2005 (JP) ..... 2005-120528

(51) Int. Cl.
*A63B 57/00* (2006.01)

(52) U.S. Cl. ..... 473/406

(58) Field of Classification Search ..... 473/406, 473/408, 387, 388, 389, 396, 397
See application file for complete search history.

(56) References Cited

U.S. PATENT DOCUMENTS

| | | | | |
|---|---|---|---|---|
| 1,735,736 | A * | 11/1929 | Davidson | 473/406 |
| 2,107,944 | A * | 2/1938 | Howard | 473/406 |
| 5,135,220 | A * | 8/1992 | Baldoni | 473/406 |
| 5,755,629 | A * | 5/1998 | Blomgren | 473/408 |
| 6,077,174 | A * | 6/2000 | Noritake | 473/406 |
| 6,170,088 | B1 | 1/2001 | Tate | |
| 6,357,642 | B1 * | 3/2002 | Marchessault et al. | 473/406 |
| 6,394,916 | B1 * | 5/2002 | Doucettperry | 473/406 |
| 7,008,336 | B2 * | 3/2006 | Bores | 473/408 |

FOREIGN PATENT DOCUMENTS

| | | | |
|---|---|---|---|
| JP | 52-106273 | U | 8/1977 |
| JP | 61-94062 | U | 6/1986 |
| JP | 62-130675 | U | 8/1987 |
| JP | 3-61962 | U | 6/1991 |
| JP | 3-101456 | U | 10/1991 |
| JP | 3-102090 | U | 10/1991 |

* cited by examiner

*Primary Examiner*—Steven Wong
(74) *Attorney, Agent, or Firm*—Birch, Stewart, Kolasch & Birch, LLP

(57) ABSTRACT

A ball marker is provided with a pivotal member (2) that is constituted by a hinged portion (5), a shaft piercing portion (6) and an insertion portion (7) and allowed to pivot, and a main body (3) that allows the pivotal member (2) to be inserted therein and shaft-engaged thereto, and in this structure, when the hinged portion (5) is raised upright on the surface of the main body (3), the insertion portion (7) is also raised upright on the back surface of the main body (3) cooperatively, and when the hinged portion (5) is laid down on the surface of the main body (3), the insertion portion (7) is also laid down on the back surface of the main body (3) cooperatively, so that a housing section used for housing the insertion portion (7) is formed on the back surface of the main body (3); thus, the insertion portion (7) is made virtually flush with the back surface of the main body, with the hinged portion (5) and the insertion (7) portion being laid down. The objective of the present invention is to provide a golf ball marker that can be visually recognized easily even from a distant location when it is placed on the green face and used, and is superior in portability.

12 Claims, 8 Drawing Sheets

GOLF BALL MARKER

BACKGROUND OF THE INVENTION

1. Field of the Invention

The present invention relates to a golf ball marker that is used for marking the position of a golf ball on the green face upon playing golf.

2. Description of the Related Art

Conventionally, with respect to the golf ball marker, a marker formed by metal or the like into a disc shape (coin shape) and a marker made from synthetic resin or the like into a disc shape with a pin-shaped insertion portion sticking downward from the center portion have been known.

For example, Japanese Utility Model Application Laid-Open No. 62-130675, Japanese Utility Model Application Laid-Open No. 61-94062 and U.S. Pat. No. 6,170,088 have proposed a golf ball marker having a structure in which a magnet is pasted to or embedded in a back surface formed into a disc shape so that the marker is detachably attached to clothes or a cap of a golf player through a clip or the like made of a magnetic material.

A problem with the conventional golf ball marker including those of Japanese Utility Model Application Laid-Open No. 62-130675, Japanese Utility Model Application Laid-Open No. 61-94062 and U.S. Pat. No. 6,170,088 is that, since, when placed on the green face and used, the ball marker is virtually made flush with the green face, it becomes difficult to visually recognize the ball marker from a distant location.

SUMMARY OF THE INVENTION

The present invention has been devised to solve the above-mentioned problem, and the objective of the present invention is to provide a golf ball marker that can be visually recognized easily even from a distant location when it is placed on the green face and used, and is superior in portability.

In order to solve the above problems, a golf ball marker according to a first aspect of the present invention includes a pivotal member having a plate-shaped hinged portion, a shaft piercing portion formed along one side face of the hinged portion, and a pin-shaped insertion portion formed in a manner so as to stick out downward from a side face of the shaft piercing portion, the pivotal member being pivotable around an axial line of the shaft piercing portion; and a main body that allows the shaft piercing portion to be fitted thereto and the pivotal member to penetrate so as to be shaft-engaged thereto, wherein when the hinged portion is raised upright on a front surface of the main body by the pivotal movement of the pivotal member, the insertion portion is also raised upright on a back surface of the main body cooperatively, when the hinged portion is laid down on the front surface of the main body by the pivotal movement of the pivotal member, the insertion portion is also laid down on the back surface of the main body cooperatively, a housing section for housing the insertion portion is formed on the back surface of the main body, and in a state in which the hinged portion and the insertion portion are laid down, the insertion portion is made either almost flush with the back surface of the main body or housed in the back surface of the main body.

Further, a golf ball marker according to a second aspect of the present invention is the golf ball marker according to the first aspect wherein a step portion having a shape corresponding to the shape of the hinged portion is formed on the front surface of the main body, and in the state in which the hinged portion and the insertion portion are laid down, the hinged portion is made almost flush with the surface of the main body.

In addition, a golf ball marker according to a third aspect of the present invention is the golf ball marker according to one of the first and second aspects further includes a holding mechanism capable of having the hinged portion be kept in the laid-down state on the surface of the main body.

Moreover, a golf ball marker according to a fourth aspect of the present invention is the golf ball marker according to the second aspect formed by die casting, wherein a magnetic member is embedded in the hinged portion, a suction face is formed in the step portion, a magnet being embedded on the back side of the suction face, and the hinged portion and the insertion portion are allowed to be kept in the laid-down state by having the magnetic member and the magnet attract each other with the suction face interposed therebetween.

Furthermore, a golf ball marker according to a fifth aspect of the present invention is the golf ball marker according to the fourth aspect that is used together with a clip having a suction plate made from a magnetic material and a hook capable of clipping clothes, wherein the golf ball marker is allowed to be held on the clip by having the magnet embedded in the back surface of the suction face and the suction plate attract each other.

In accordance with the present invention, since a hinged portion that can be laid and raised on and from the main body front surface is prepared, the hinged portion is raised upright when the ball marker is placed on the green face and used so that the ball marker can be visually recognized easily even from a distant location.

Moreover, in accordance with the present invention, since the hinged portion and the insertion portion are respectively made virtually flush with the main body front surface as well as with the main body back surface, with the raising portion and the insertion portion being laid down, it becomes possible to provide a ball marker that is also superior in portability.

DESCRIPTION OF THE PREFERRED EMBODIMENTS

Figure 1:
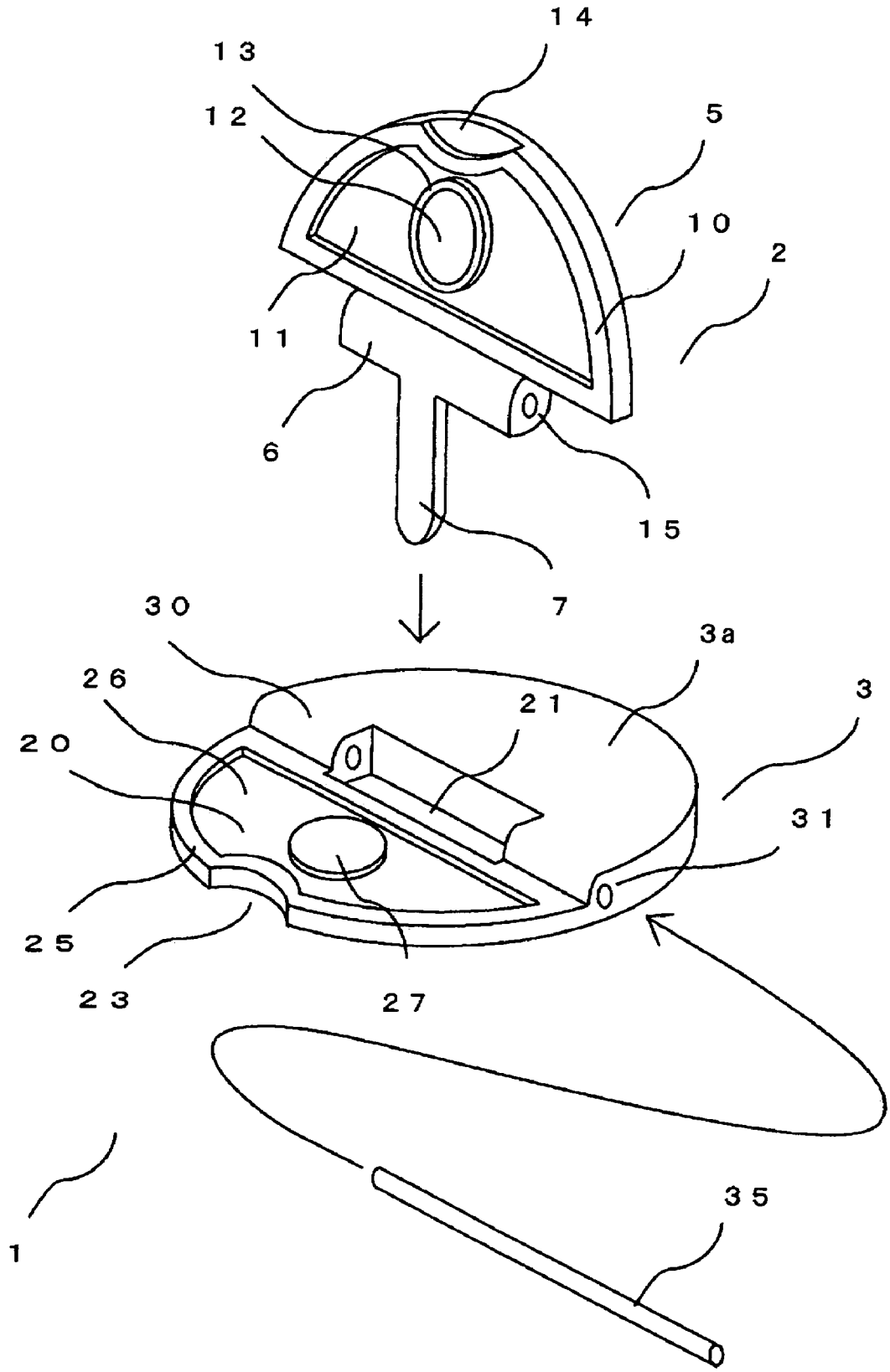
FIG. 1 is an exploded perspective view that shows a ball marker in accordance with the present invention.

A ball marker in accordance with the present invention is provided with a pivotal member and a main body, and has a structure in which the pivotal member is shaft-engaged with the main body so as to pivot thereon.

The pivotal member is provided with a hinged portion that can be visually recognized even from a distant location when the ball marker is placed on the green face and used. The hinged portion is preferably formed into a flat plate shape, although any shape may be used as the hinged portion.

A shaft piercing portion, for example, made of a straight small member, is placed on one side face of the hinged portion, and a pin-shaped insertion portion is formed in a manner so as to be suspended from the side face of the shaft piercing portion.

The pin-shaped insertion portion may be formed into a linear plate shape or a column shape or a polygonal pillar shape such as a prism shape; however, for the purposes of thinning the thickness of the ball marker and the like, the linear plate shape is preferably used. In any of these shapes, the tip portion is preferably narrowed gradually so as to be easily pushed into the green face.

Moreover, a plurality of pin-shaped insertion portions may be formed; however, one insertion portion is preferably used from the viewpoints of preventing the ball marker from becoming bulky and of reducing the costs.

In the above-mentioned mode, irregularities may be formed on the surface thereof; however, the surface is preferably formed into a smooth face without irregularities from the viewpoint of an insertion property into the green face.

The length of the insertion portion (pin) is preferably set in a range from 3 to 20 mm. The length of less than 3 mm tends to cause instability when inserted into the green face. In contrast, the length exceeding 20 mm tends to make the ball marker bulky; therefore, it is preferably set to 5 mm or more, more preferably, in a range from 7 mm or more to 12 mm or less.

Moreover, the cross-sectional area of the insertion portion (pin) is preferably set in a range from 0.5 to 20 $mm^2$. The cross-sectional area of less than 0.5 $mm^2$ tends to cause degradation in the strength of the pin; in contrast, the cross-sectional area exceeding 20 $mm^2$ tends to cause difficulty upon insertion into the green face and make the ball marker bulky; therefore, the cross-sectional area is preferably set in a range from 0.8 $mm^2$ or more to 15 $mm^2$ or less, more preferably, in a range from 1.0 $mm^2$ or more to 10 $mm^2$ or less.

In the case when the insertion portion (pin) is formed into a linear plate shape, the value of T/W that is a ratio of the width W of the insertion portion (width measured in the shaft member direction) and the thickness T of the insertion portion (thickness measured in a vertical direction to the length direction of the insertion portion as well as in a vertical direction to the shaft member direction) is preferably set in a range from 0.2 to 1.5. The ratio of less than 0.2 causes the insertion portion to become too thin and consequently to have a reduction in strength, and makes the width greater resulting in a bulky ball mark. In contrast, the ratio exceeding 1.5 makes the thickness of the ball marker greater; therefore, the ratio is more preferably set in a range from 0.3 or more to 1.25 or less, most preferably, in a range from 0.5 or more to 0.8 or less.

The main body is preferably made to have a plane surface area greater than the pivotal member and such a structure as to allow the shaft piercing portion to be fitted thereto. The main body and the shaft piercing portion are connected to each other, for example, through a hinge structure so that the pivotal member is fitted thereto, with the hinged portion being placed on the main body front surface side and with the insertion portion being placed on the main body back surface side. Here, the insertion portion is designed to be raised and laid down on the main body back surface side in cooperation with movements of the hinged portion that are raised and laid down on the main body front surface side, as the shaft piercing portion is allowed to pivot.

In order to allow the hinged portion and the insertion portion to be raised up and laid down in a well balanced state, the shaft piercing portion is preferably shaft-engaged with the main body on a straight line position that virtually divides the plane formed by the main body into two portions.

Moreover, a step portion having a shape corresponding to the shape of the hinged portion is formed on the main body front surface so that, when the hinged portion is laid down, the hinged portion is made virtually flush with the main body front surface, and a housing section used for housing the insertion portion is also formed on the main body back surface so that, when the insertion portion is laid down, the insertion portion is made virtually flush with the main body back surface; thus, in a state in which the hinged portion and the insertion portion are laid down, the hinged portion and the insertion portion are prevented from excessively protruding from the main body to form a virtually flat plate shape as a whole. Here, the insertion portion may be housed into the main body back surface, when the insertion portion is laid down.

The ball marker in accordance with the present invention is preferably formed so as to have a holding mechanism used for having the hinged portion be kept in the laid-down state on the main body front surface. With respect to such a holding mechanism, a mechanism utilizing a magnetic force is preferably used, and, for example, the ball marker having the following mode is prepared.

(a) A magnetic member is attached to the hinged portion, with a magnet being attached to the main body.
(b) A magnetic member is attached to the hinged portion, with a magnet and a magnetic member being attached to the main body (with the magnetic member being placed on the hinged portion side).
(c) A magnet is attached to the hinged portion, with a magnetic member being attached to the main body.
(d) A magnet and a magnetic member are attached to the hinged portion (with the magnetic member being placed on the main body side), with a magnetic member being attached to the main body.
(e) A magnet is attached to the hinged portion, with a magnet being attached to the main body.
(f) A magnet and a magnetic member are attached to the hinged portion (with the magnetic member being placed on the main body side), with a magnetic member and a magnetic member being attached to the main body (with the magnetic member being placed on the hinged portion side).
(g) In the above-mentioned structures (a) to (f), thin non-magnetic films are formed on the surface of a place corresponding to the hinged portion as well as on the surface of a place corresponding to the main body.

With respect to the magnet, more specifically, a permanent magnet is used, and, for example, an alnico magnet, a ferrite magnet, a rare-earth magnet or the like may be used; in particular, a ferrite magnet is preferably used.

Moreover, with respect to the magnetic member, more specifically, a ferromagnetic material is used, and, for example, pure iron-mild steel, silicon iron, Fe—Ni alloy, Fe—Co alloy, Fe—Cr alloy, ferrite, Sendust and the like may be used; in particular, pure iron-mild steel is preferably used.

In addition to the above-mentioned mode, the ball marker having the following mode may be used.

(h) A fitting-in means is prepared in the insertion portion or the housing section (for example, the insertion portion is made of metal, with the insertion portion contacting part of the housing section being formed by an elastic member, or the housing section is made of metal with the housing section contacting portion of the insertion portion being formed by an elastic member).

(i) A fitting-in means is prepared at a portion other than the insertion portion or the housing section.

For example, a structure in which, when the pivotal member is raised virtually upright vertically to the main body, the insertion portion is made in contact with one portion of the main body and stopped is prepared, that is, a means by which, when the pivotal member is raised virtually upright vertically to the main body, the pivotal movement is stopped is prepared; thus, the insertion process into the green face is easily carried out. Here, the virtually vertical position preferably ranges from 80 degrees to 100 degrees, more preferably, from 85 to 95 degrees.

The ball marker may have any shape such as a round shape, an elliptical shape, a triangle shape, a square shape and a polygonal shape, in its plan view; however, from the viewpoint of portability, it is preferably formed into a thin shape with a size as small as possible. With respect to the material thereof, not particularly limited, various materials such as metal and synthetic resins may be used.

Embodiment 1

Referring to Figures, the following description will discuss the first embodiment of the present invention.

Figure 2:
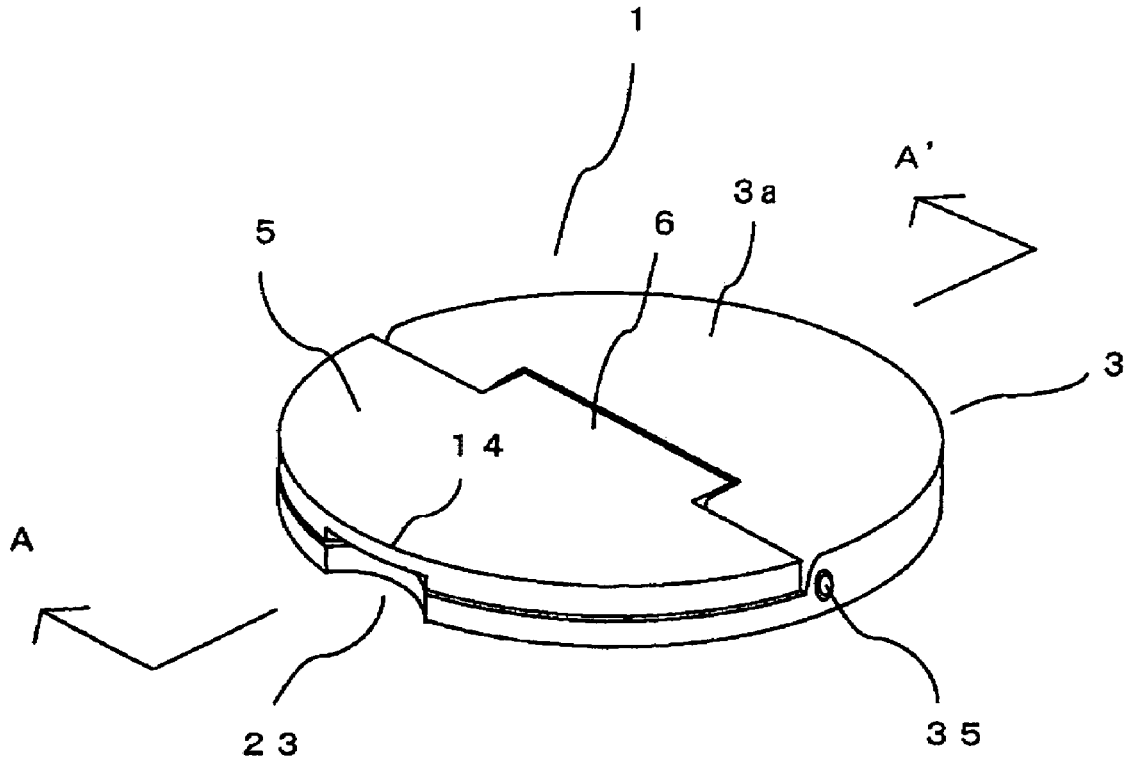
FIG. 2 is a perspective view showing the surface side of the ball marker in a laid down state of the ball marker.
Figure 3:
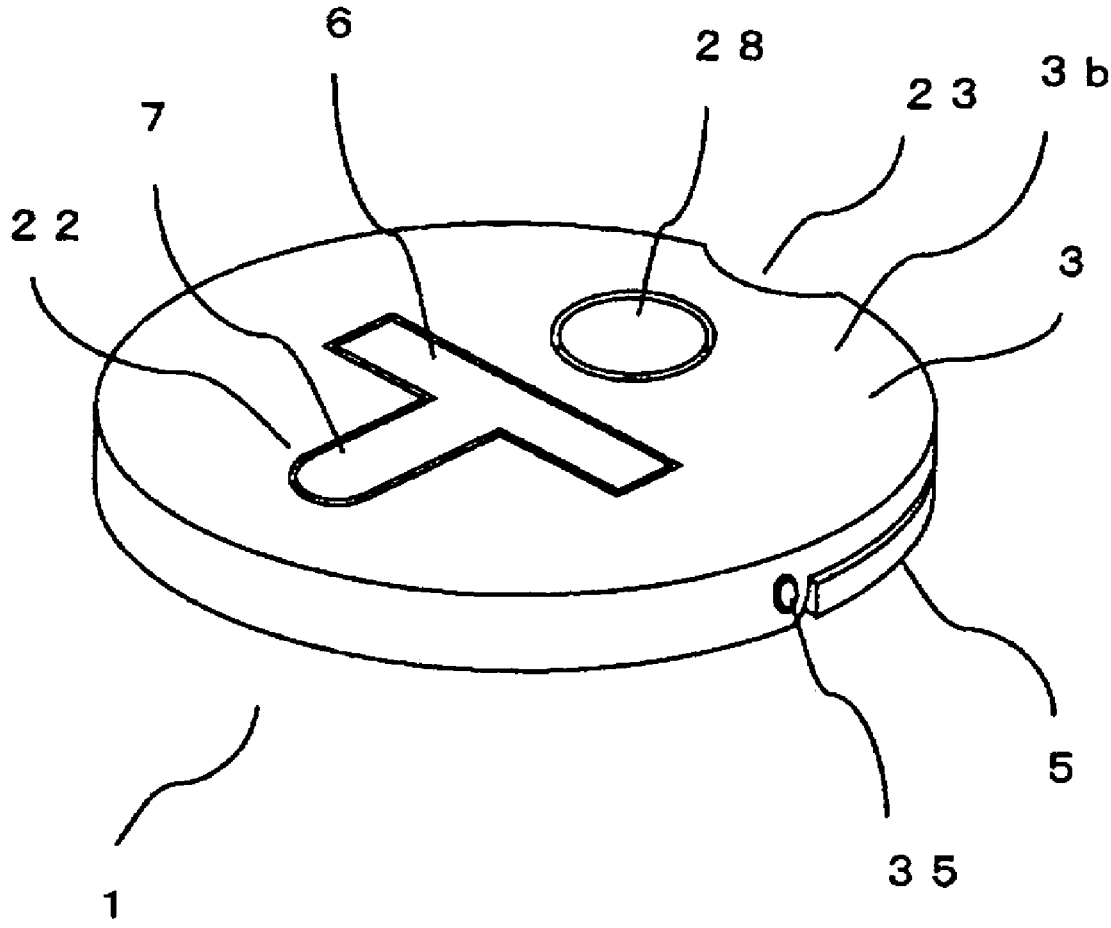
FIG. 3 is a perspective view showing the back surface side of the ball marker in a laid down state of the ball marker.

As shown in FIG. 1, a ball marker (1) in accordance with the present embodiment is constituted by a pivotal member (2) and a main body (3) that is coupled to the pivotal member (2) through a shaft member (35) so as to allow it to pivot thereon, and as shown in FIGS. 2 and 3, formed into a disc shape (25 mm in diameter and 3 mm in thickness), with the pivotal member (2) being laid down. The ball marker (1) of the present embodiment is formed through die casting.

As shown in FIG. 1, the pivotal member (2) is constituted by a plate-shaped hinged portion (5) having a semi-circular shape, a shaft piercing portion (6) that is formed in an extended manner along a straight portion on the side face of the hinged portion (5) and a linear plate-shaped insertion portion (7) with a tip having a virtually round shape, which is formed on the side face of the shaft piercing portion (6) so as to stick out downward.

As shown in FIG. 1, a peripheral edge portion (10) is formed on the back surface with a concave portion (11) formed inside thereof, and a magnetic member (12) (4.5 mm in diameter) having a disc shape, made from iron or the like, is embedded in a virtually center-of-gravity position thereof in a manner so as to protrude from the concave portion (11) to a level as high as the peripheral edge portion (10). A peripheral edge portion (13) is formed along the periphery of the magnetic member (12).

Moreover, a fingering portion (14), which is prepared by bending the peripheral edge portion (10) inward to form a curved line, is formed in the middle position of the curved-line portion of the hinged portion (5).

As shown in FIG. 1, the shaft piercing portion (6) has a virtually hollow cylinder shape with a shaft hole portion (15) in an axial direction so that the shaft member (35) is inserted therethrough, and is formed so that the straight-line portion of the hinged portion (5) is made in parallel with the axial line, with a length shorter than the straight line portion.

Figure 6:
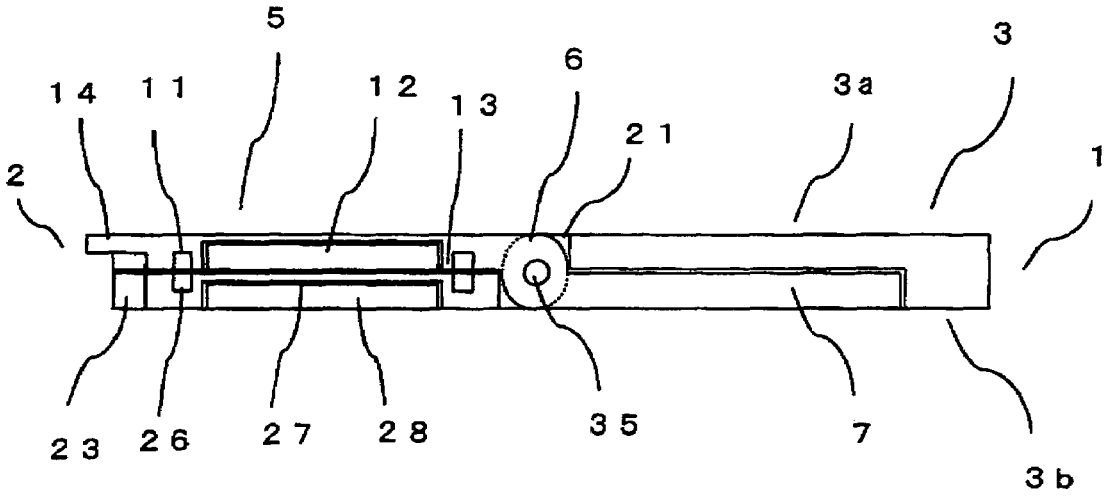
FIG. 6 is a cross-sectional view taken along line A-A' of FIG. 2.
Figure 7:
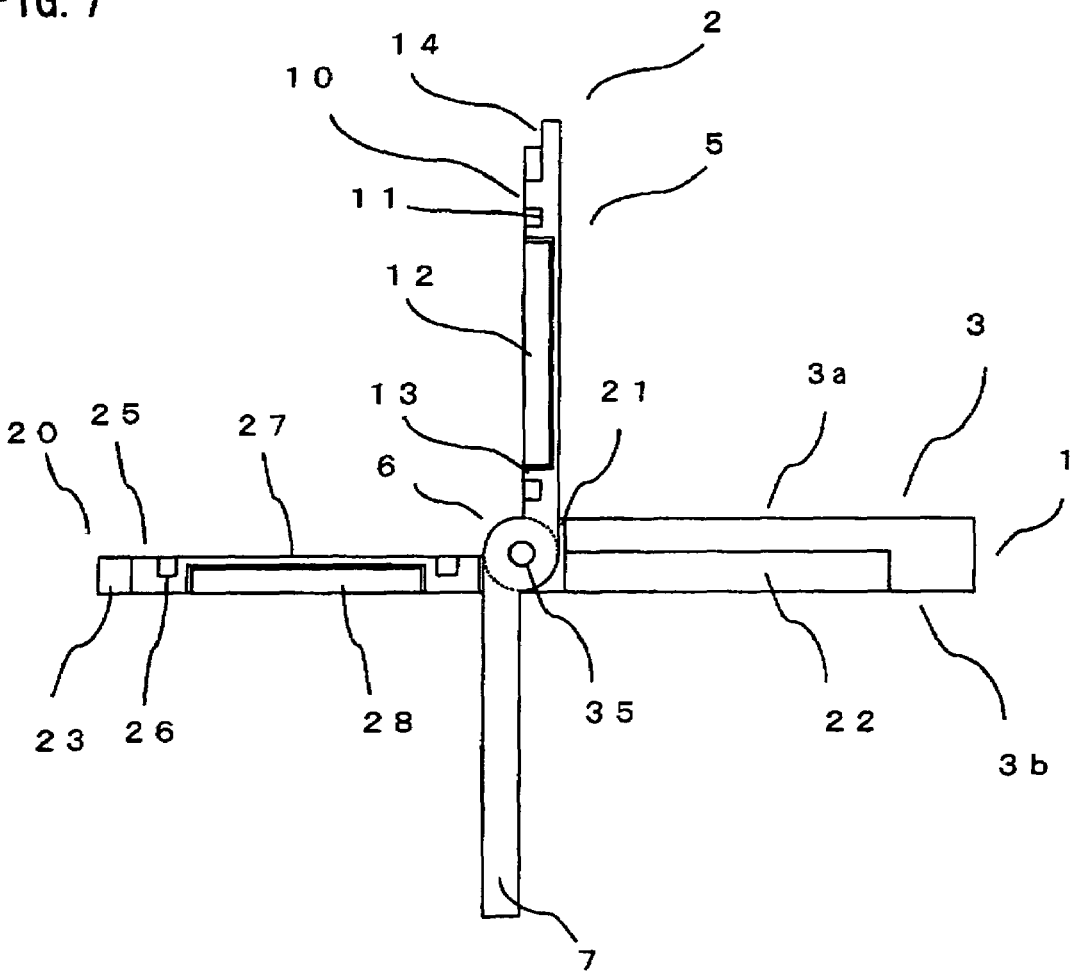
FIG. 7 is a cross-sectional view taken along line B-B' of FIG. 4.

Moreover, as shown in FIGS. 6 and 7, the shaft piercing portion (6), which basically has a cylinder shape having a diameter corresponding to virtually the thickness of the main body (3), is molded integrally with the hinged portion (5) and the insertion portion (7) in such a manner that, when the pivotal member (2) is laid down horizontally, the hinged portion (5) and the insertion portion (7) are allowed to form a plane that is made in contact with the respective upper and lower side faces of the shaft piercing portion (6) and that, when the pivotal member (2) is raised upright vertically, the hinged portion (5) and the insertion portion (7) are allowed to form a plane that is made in contact with the right and left side faces of the shaft piercing portion (6).

As shown in FIGS. 1 to 7, a step portion (20) having a shape corresponding to the shape of the hinged portion (5) of the pivotal member (2) is formed on the surface (3*a*) side of the main body. Moreover, an opening (21) to which the shaft piercing portion (6) of the pivotal member (2) is fitted is formed in the center of the main body (3) in a manner so as to penetrate from the surface to the back surface, and a housing section (22), used for housing the insertion portion (7) of the pivotal member (2), is formed on the back surface (3*b*) of the main body.

As shown in FIG. 1, the step portion (20) has a semi-circular shape with virtually the same plane area as the hinged portion (5), and is formed at a position apart from the main body front surface (3*a*) downward by a length corresponding to virtually the thickness of the hinged portion (5). A cut-out section (23) is formed at a position of the step portion (20) corresponding to the fingering portion (14) of the hinged portion (5).

A peripheral edge portion (25) is formed on the step portion (20) with a concave portion (26) being formed inside thereof, and as shown in FIGS. 6 and 7, a suction face (27) (0.2 mm in thickness) used for sucking the magnetic member (12) of the hinge portion (5) is formed at a predetermined position in a manner so as to stick out from the concave portion (26) at the same height as the peripheral edge portion (25). On the back side of the suction face (27), a disc-shaped magnet (28) (4.5 mm in diameter and 1.0 mm in thickness) is embedded from the main body back surface (3*b*) side so as to be made flush with the main body back surface (3*b*).

As shown in FIG. 1, the opening (21), which has a length and a width that are slightly longer than the shaft piercing portion (6) so as to allow the shaft piercing portion (6) fitted thereto to pivot therein, is formed at a position on the diameter of the main body (3), and a pair of shaft supporting portions (30) are formed at the two ends in the length direction of the opening (21) so as to face each other with the opening (21) located in between. The shaft supporting portion (30) has a shaft hole section (31) that penetrates from each of the side faces of the main body (3) to the opening (21) so that the shaft member (35) is inserted therethrough to be supported so as not to pivot. The opening (21) and the shaft supporting portion (30) may have any other shapes as long as they are shaft-engaged with the shaft piercing portion (6) so as to allow it to pivot, with the hinged portion (5) and the insertion portion (7) being freely raised up and laid down.

As shown in FIG. 3 and FIGS. 5 to 7, the housing section (22), which has a shape slightly larger than the insertion portion (7) of the pivotal member (2), is formed as a recessed section that is partially connected to the opening (21) at a predetermined position of the main body back surface (3*b*) opposite to the step portion (20) with the opening (21) located in between.

As shown in FIGS. 4 to 7, the ball marker (1) of the present embodiment, which is provided with the pivotal member (2) and the main body (3), has a structure in which the hinged portion (5) is positioned on the main body front surface (3*a*) while the insertion portion (7) is positioned on the main body back surface (3*b*) so that the shaft piercing portion (6) is fitted and inserted into the opening (21) of the main body (3), with the pivotal member (2) being allowed to penetrate through the main body (3) from the main body front surface (3*a*).

Moreover, as shown in FIG. 1, a rod shaped shaft member (35) with a round shape in its cross section, having a length virtually corresponding to the length of the diameter of the main body (3), is allowed to penetrate the main body (3) along its diameter through the shaft hole section (31) of the shaft supporting portion (30) and the shaft hole section (15) of the shaft piercing portion (6), and the shaft member (35) is supported by the shaft supporting portion (30) so as not to pivot by using securing means such as brazing so that the shaft piercing portion (6) is allowed to pivot around the shaft member (35), with the hinged portion (5) and the insertion portion (7) serving as an integral portion. Here, two shaft members having a length shorter than the radius of the main body (3) may be used so that these are respectively inserted from the two side ends of the main body (3) so that the shaft piercing portion (6) may be shaft-engaged thereto.

With this arrangement, as shown in FIGS. 2 to 7, simultaneously as the hinged portion (5) is raised upright on the main body front surface (3*a*) side, the insertion portion (7) is also raised upright on the main body back surface (3*b*) side; moreover, simultaneously as the hinged portion (5) is laid down on the main body front surface (3*a*) side, the insertion portion (7) is also laid down on the main body back surface (3*b*) side.

In the upright state, the insertion portion (7) sticks out downward in the center of the main body back surface (3*b*), and the hinged portion (5) or the insertion portion (7) is made in contact with the side wall of the main body opening (21) so that these are prevented from pivoting beyond the vertical position. Here, another structure in which a protrusion is formed on the opening (21) so that each of rising movements of the hinged portion (5) and the insertion portion (7) is limited at a predetermined position by the contact between the protrusion and the shaft piercing portion (6) may be used, and in this case, a cut-out section having a shape corresponding to the protrusion is preferably formed in the shaft piercing portion (6) so that the pivotal movement of the shaft piercing portion (6) is not blocked. From viewpoints of functions to be exerted by the hinged portion (5) and the insertion portion (7), a structure which stops the rising movements thereof at positions where they are virtually placed vertically is preferably prepared.

Moreover, as shown in FIGS. 2 and 3, and FIG. 6, when the hinged portion (5) and the insertion portion (7) are laid down, the hinged portion (5) is housed on the step portion (20) so as to be made flush with the main body front surface (3*a*), and the insertion portion (7) is also housed in the housing section (22) so as to be made flush with the main body back surface (3*b*).

Next, the following description will discuss the mode of use of the ball marker (1) in accordance with the present invention.

First, when the ball marker (1) is carried, the hinged portion (5) and the insertion portion (7) are laid down to form a disc shape, as shown in FIGS. 2 and 3, and FIG. 6.

At this time, by the function of the magnetic member (12) of the hinged portion (5) and the magnet (28) embedded on the suction face (27) back side, the hinged portion (5) is sucked and held onto the step portion (20) of the main body (3), while the insertion portion (7) is housed and held in the housing section (22) of the main body back surface (3*b*).

Figure 4:
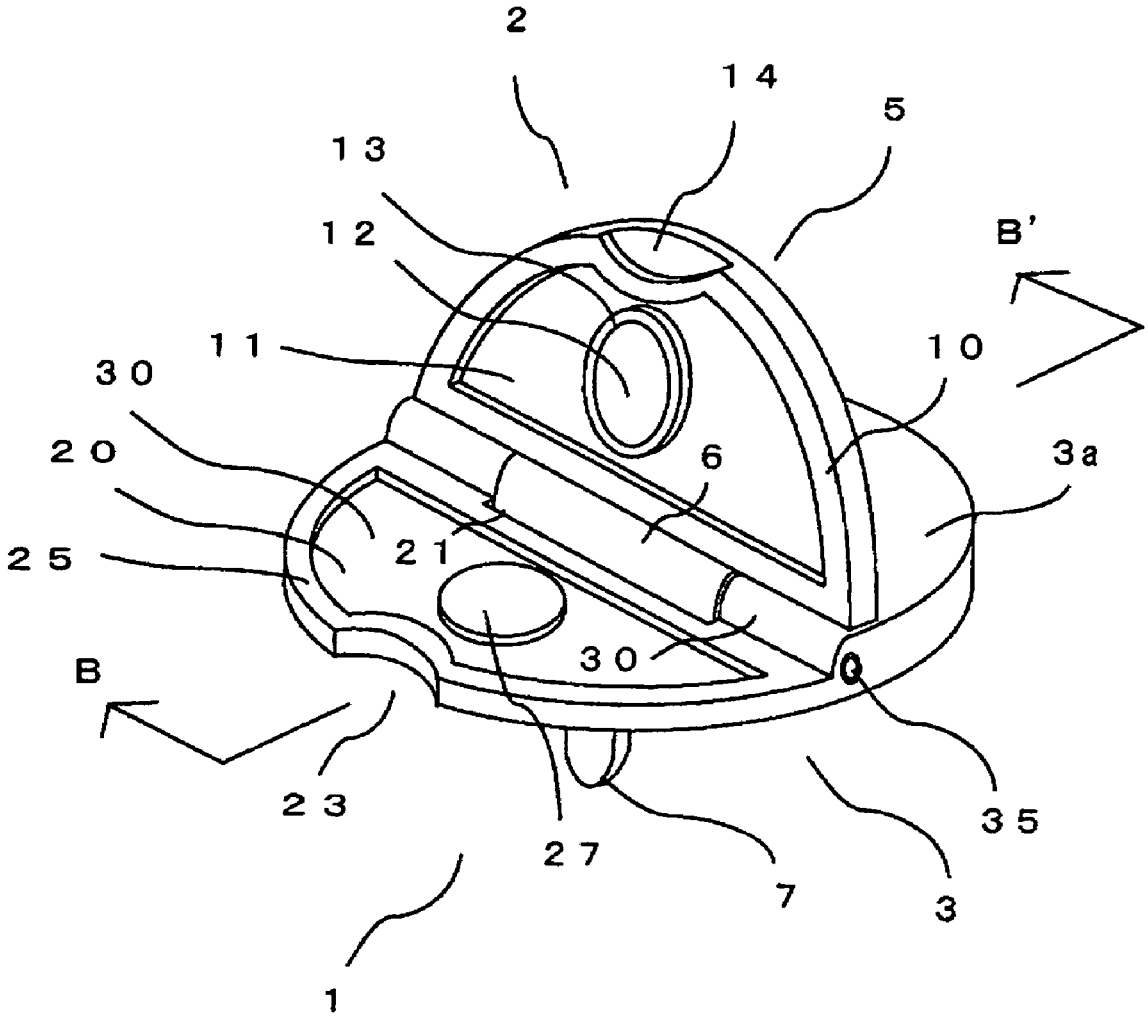
FIG. 4 is a perspective view showing the surface side of the ball marker in an upright state of the ball marker.
Figure 5:
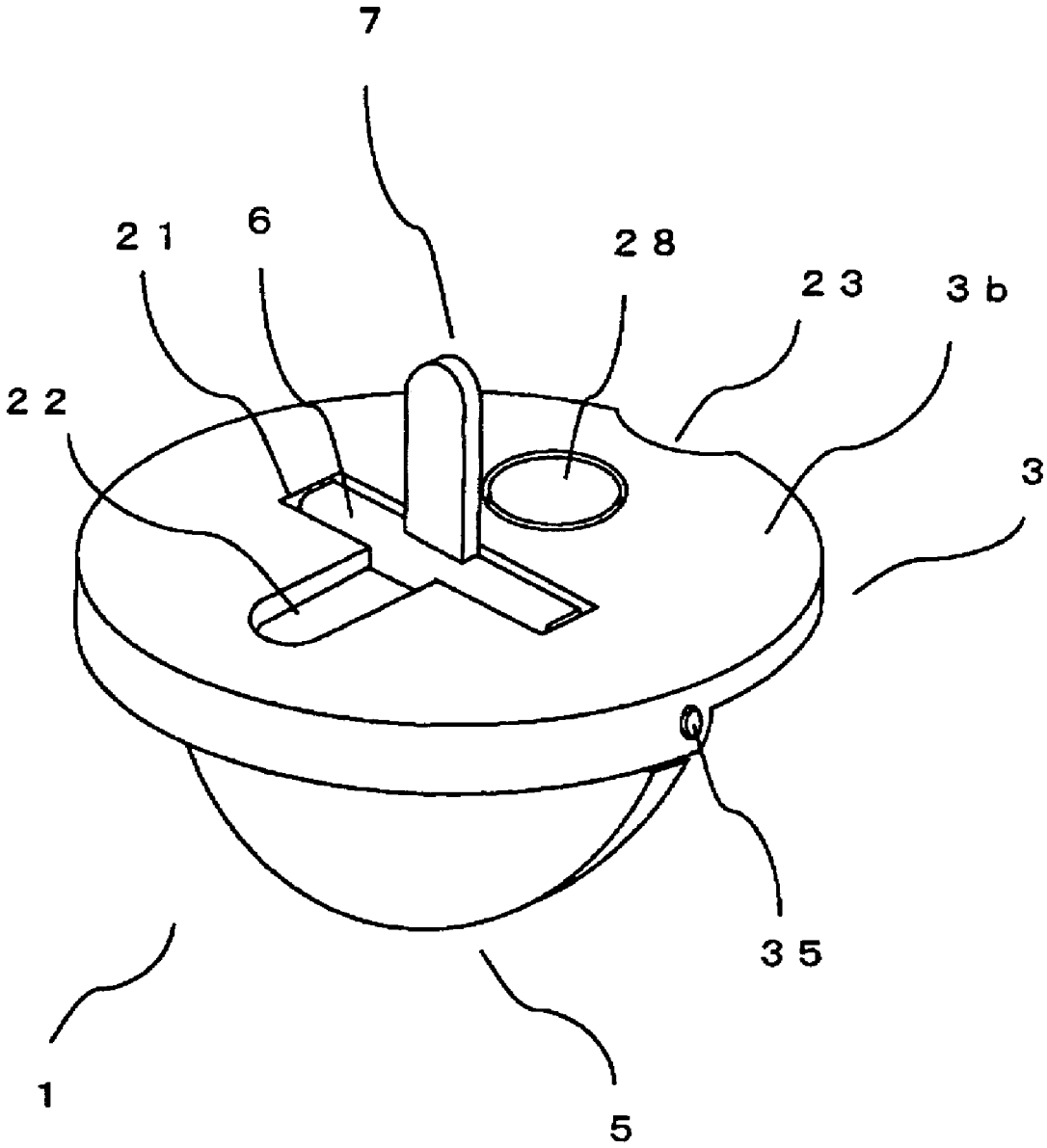
FIG. 5 is a perspective view showing the back surface side of the ball marker in an upright state of the ball marker.

When, upon playing golf, the ball is put on the green so that the ball position is marked, a finger is put on the fingering portion (14) of the ball marker (1) and the hinged portion (5) is raised against a magnetic force exerted between the magnetic member (12) and the magnet (28). Then, as shown in FIGS. 4 and 5, and FIG. 7, the insertion portion (7) is also raised on the main body back surface (3*b*) in cooperation with the rise of the hinged portion (5).

Thus, with the hinged portion (5) and the insertion portion (7) being raised upright vertically, the insertion portion (7) is inserted into the green face so that the ball position is marked. At this time, since the insertion portion (7) is secured so as not to pivot on the green face, the hinged portion (5) is also fixed in its upright state.

Upon completion of the marking of the ball position, the hinged portion (5) is grabbed by fingers and raised upward so that the insertion portion (7) is drawn out of the green face. When dust or the like adheres to the insertion portion (7), this is wiped, and the hinged portion (5) is laid down to be sucked onto the main body suction face (27) so that the insertion portion (7) is simultaneously laid down and housed in the main body back surface (3*b*) to form the disc shape again that is suitable for portable use.

When it is not necessary to mark the ball by raising the hinged portion (5), for example, when the position of the ball is close to the cup, the ball marker may be used with the hinged portion (5) and the insertion portion (7) being laid down.

In accordance with the ball marker (1) of the present embodiment, since the hinged portion (5) is raised on the main body front surface (3*a*), the position of the ball marker (1) can be visually recognized easily even from a distant location.

Moreover, since the upright state of the hinged portion (5) is maintained by inserting the insertion portion (7) onto the green face, it is possible to prevent the marker from falling down due to wind or the like, and consequently to visually recognize the hinged portion (5) under any conditions.

The ball marker (1) of the present embodiment is formed into a compact disc shape when the hinged portion (5) and the insertion portion (7) are laid down, with the hinged portion (5) and the insertion portion (7) being maintained in the laid down state through a function between the magnetic member (12) embedded in the hinged portion (5) and the magnet (28) embedded in the main body (3); therefore, it is possible to provide a superior portability.

Moreover, the ball marker (1) of the present embodiment is formed through die casting, and has a structure in which the magnetic member (12) of the hinged portion (5) and the magnet (28) of the step portion (20) are attracted to each other, with the suction face (27) interposed in between; therefore, it becomes possible to make the entire thickness thinner to achieve a light-weight device, and also to appropriately adjust the magnetic force so that the hinged portion (5) is easily raised.

Embodiment 2

Referring to Figures, the following description will discuss the second embodiment. The present embodiment relates to a modified example of the ball marker of the above-mentioned embodiment.

Figure 8:
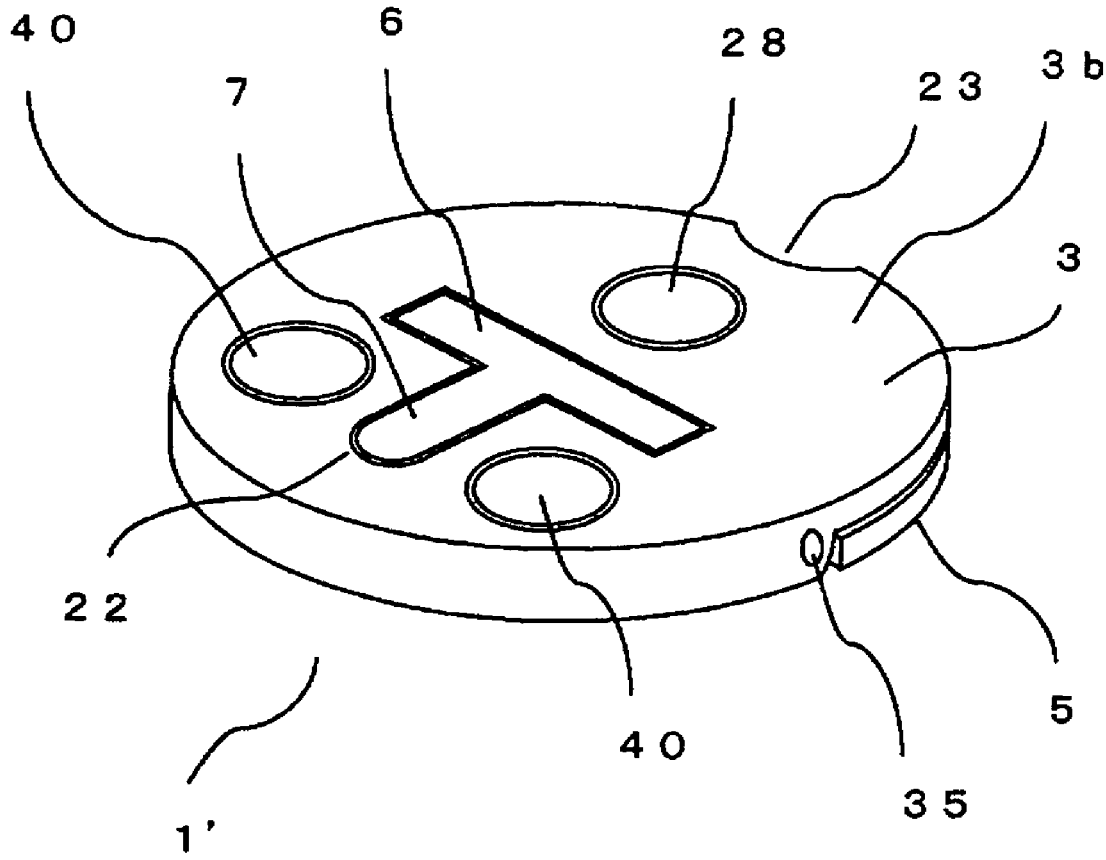
FIG. 8 is a perspective view showing the back surface side of the ball marker in a laid down state of a ball marker in accordance with a modified example of the present invention.

As shown in FIG. 8, a ball marker (1') in accordance with the present embodiment has a structure in which two round magnets (40) are further embedded in the main body back surface (3*b*) of the ball marker (1) relating to the above-mentioned embodiment, with a housing section (22) being sandwiched in between.

Figure 9:
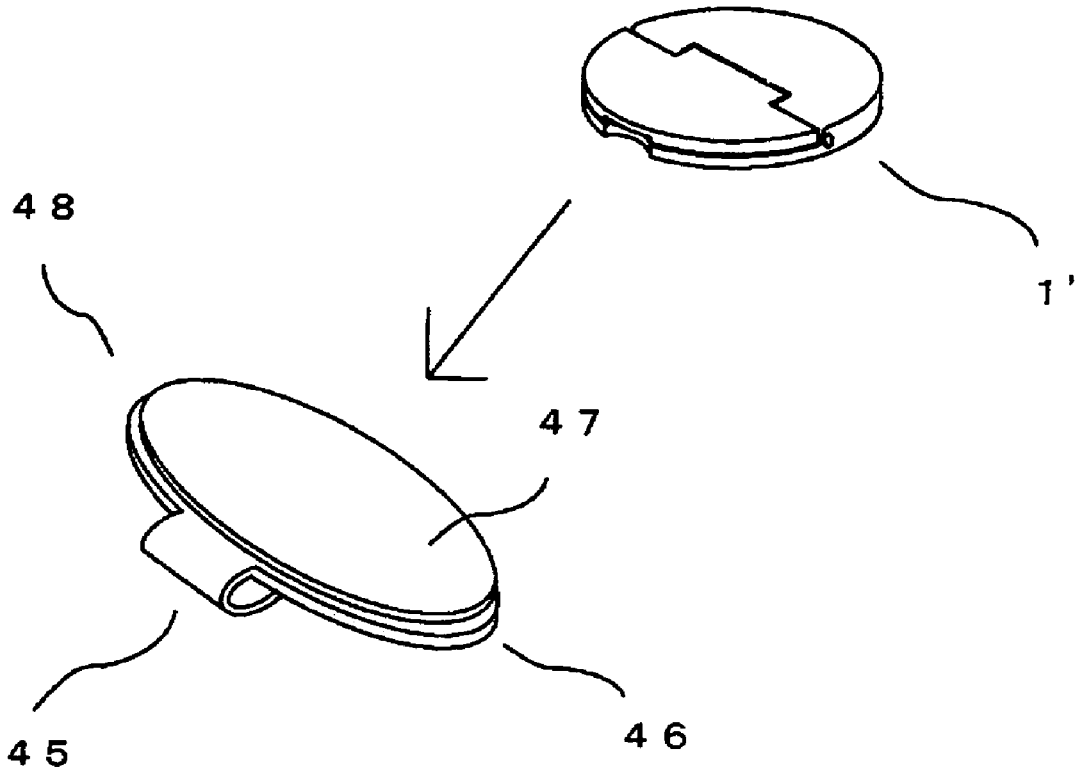
FIG. 9 is a perspective view showing the surface side of the ball marker in use in accordance with the modified example of the present invention.
Figure 10:
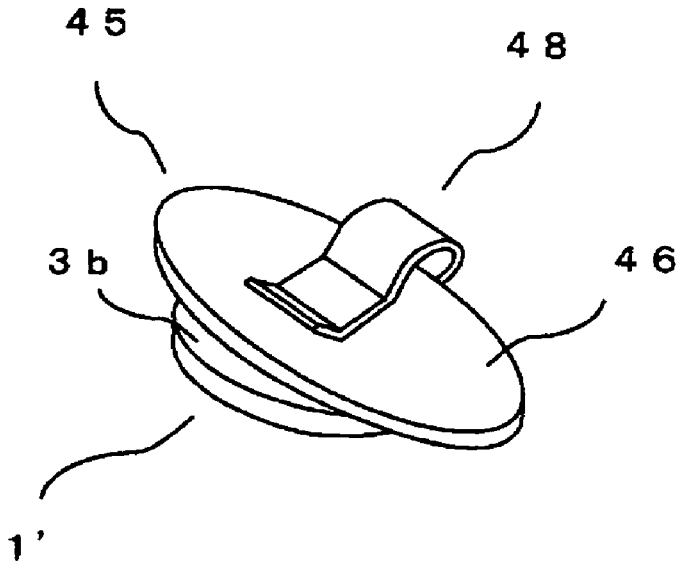
FIG. 10 is a perspective view showing the back surface side of the ball marker in use in accordance with the modified example of the present invention

As shown in FIGS. 9 and 10, the ball marker (1') of the present embodiment is used together with a clip (45) for the ball marker.

The clip (45) is constituted by a substrate (46) having a virtually elliptical shape and a suction plate (47) made of a magnetic material, which has a virtually elliptical shape, and is placed on the substrate (46) with a size slightly smaller than the substrate (46). A hook (48) to be adhered to clothes or the like is integrally molded together with the substrate (46).

When the ball marker (1') of the present embodiment is used, the clip (45) is preliminarily attached to a brim of a cap, a pocket of a trouser, a belt or the like, by using the hook (48).

Upon carrying the ball marker (1'), as shown in FIGS. 8 to 10, the ball marker (1'), which has been formed into a disc shape with the hinged portion (5) and the insertion portion (7) being laid down, is held on clip (45) by allowing the magnets (28)(40) on the main body back surface (3*b*) and the suction plate (47) to attract to each other.

When, upon playing golf, the ball position is marked, the ball marker (1') is detached from the clip (45), in the same manner as the above-mentioned embodiment, the hinged portion (5) and insertion portion (7) are raised upright, and the ball position is marked by inserting the insertion portion (7) onto the green face.

Upon completion of the marking of the ball position, the ball marker (1') is drawn from the green face, and the hinged portion (5) and the insertion portion (7) are laid down to be formed into the disc shape again so that the ball marker (1') is sucked to the clip (45) and carried.

With respect to the suction plate (47), any other shape and size may be used as long as they are suitable for sucking and maintaining the three magnets (28)(40) embedded in the main body back surface (3*b*) of the ball marker, and the substrate (46) and hook (48) are not intended to be limited by the structures shown in FIGS. 9 and 10. The suction plate (47) and the hook (48) may be integrally molded without installing the substrate (46).

Moreover, when the magnet (28) to be placed on the suction face (27) back side has a sufficient magnetic force, the magnet (40) near the housing section (22) may be omitted so that only the single magnet (28) is used for sucking and maintaining the suction plate (47).

As shown in the present embodiment, the ball marker (1') is held on the clip (45) that is attachable to clothes or the like so that it is possible to improve the portability of the ball marker (1') and also to provide a loss preventing effect. Since the ball marker (1') is detached from the clip (45) when used, it is possible to provide a golf ball marker (1') that can be visually recognized easily as described earlier.

In particular, in the present embodiment, the magnet (28) embedded in the main body back surface (3*b*) is effectively used for sucking the hinged portion (5), and two magnets (40) are further embedded with the housing section interposed in between; therefore, the ball marker (1') is firmly sucked to the clip (45) so that it becomes possible to prevent the ball marker (1') from coming off and falling from the clip (45).

The objective of the present invention is to provide a golf ball marker that can be visually recognized easily when it is placed on the green face and used, and is superior in portability, and the golf ball marker has a desirable industrial applicability.

What is claimed is:

1. A golf ball marker formed by die casting, comprising:

a pivotal member that includes a plate-shaped hinged portion, a shaft piercing portion formed along one side face of the hinged portion, and a pin-shaped insertion portion formed in a manner so as to stick out downward from a side face of the shaft piercing portion, the pivotal member being pivotable around an axial line of the shaft piercing portion; and a main body that allows the shaft piercing portion to be fitted thereto and the pivotal member to penetrate so as to be shaft-engaged thereto via a shaft extending through the shaft piercing portion and the main body, wherein when the hinged portion is raised upright on a front surface of the main body by the pivotal movement of the pivotal member, the insertion portion is also raised upright on a back surface of the main body cooperatively, when the hinged portion is laid down on the front surface of the main body by the pivotal movement of the pivotal member, the insertion portion is also laid down on the back surface of the main body cooperatively, a housing section for housing the insertion portion is formed on the back surface of the main body, in a state in which the hinged portion and the insertion portion are laid down, the insertion portion is made either substantially flush with the back surface of the main body or housed in the back surface of the main body, wherein a step portion having a shape corresponding to the shape of the hinged portion is formed on the front surface of the main body, and in the state in which the hinged portion and the insertion portion are laid down, the hinged portion is made substantially flush with the surface of the main body, and wherein a magnetic member is embedded in the hinged portion, a suction face is formed in the step portion, a magnet being embedded on the back side of the suction face, and the hinged portion and the insertion portion are allowed to be kept in the laid-down state by having the magnetic member and the magnet attract each other with the suction face interposed therebetween.

2. The golf ball marker according to claim 1, used together with a clip having a suction plate made from a magnetic material and a hook capable of clipping clothes, wherein the golf ball marker is allowed to be held on the clip by having the magnet embedded in the back surface of the suction face and the suction plate attract each other.

3. A golf ball marker comprising:

a pivotal member that includes a plate-shaped hinged portion, a shaft piercing portion formed along one side face of the hinged portion, and a pin-shaped insertion portion formed in a manner so as to stick out downward from a side face of the shaft piercing portion, the pivotal member being pivotable around an axial line of the shaft piercing portion; and a main body that allows the shaft piercing portion to be fitted thereto and the pivotal member to penetrate so as to be shaft-engaged thereto via a shaft extending through the shaft piercing portion and the main body, wherein when the hinged portion is raised upright on a front surface of the main body by the pivotal movement of the pivotal member, the insertion portion is also raised upright on a back surface of the main body cooperatively, when the hinged portion is laid down on the front surface of the main body by the pivotal movement of the pivotal member, the insertion portion is also laid down on the back surface of the main body cooperatively, a housing section for housing the insertion portion is formed on the back surface of the main body, and in a state in which the hinged portion and the insertion portion are laid down, the insertion portion is made either substantially flush with the back surface of the main body or housed in the back surface of the main body, the ball marker being formed in a disc shape when the hinged portion and the insertion portion are laid down.

4. The golf ball marker according to claim 3, formed by die casting, wherein a magnetic member is embedded in the hinged portion, a suction face is formed in the step portion, a magnet being embedded on the back side of the suction face, and the hinged portion and the insertion portion are allowed to be kept in the laid-down state by having the magnetic member and the magnet attract each other with the suction face interposed therebetween.

5. The golf ball marker according to claim 4, used together with a clip having a suction plate made from a magnetic material and a hook capable of clipping clothes, wherein the golf ball marker is allowed to be held on the clip by having the magnet embedded in the back surface of the suction face and the suction plate attract each other.

6. The golf ball marker according to claim 3, wherein a step portion having a shape corresponding to the shape of the hinged portion is formed on the front surface of the main body;

a back surface of the step portion is configured as a part of the back surface of the main body; and in the state in which the hinged portion and the insertion portion are laid down, the hinged portion touches the stepped portion.

7. The golf ball marker according to claim 4, used together with a clip having a suction plate and a hook capable of clipping clothes, wherein the golf ball marker is allowed to be held on the clip by having the back surface of the main body and the suction plate attract each other.

8. A golf ball marker comprising:

a pivotal member that includes a plate-shaped hinged portion, a shaft piercing portion formed along one side face of the hinged portion, and a pin-shaped insertion portion formed in a manner so as to stick out downward from a side face of the shaft piercing portion, the pivotal member being pivotable around an axial line of the shaft piercing portion; and a main body that allows the shaft piercing portion to be fitted thereto and the pivotal member to penetrate so as to be shaft-engaged thereto via a shaft extending through the shaft piercing portion and the main body, the main body including a step portion having a shape corresponding to the shape of the hinged portion is formed on the front surface of the main body, the step portion having substantially the same plane area as the hinged portion, the step portion being formed at a position apart from the front surface of the main body downward by a length corresponding substantially to the thickness of the hinged portion, wherein when the hinged portion is raised upright on a front surface of the main body by the pivotal movement of the pivotal member, the insertion portion is also raised upright on a back surface of the main body cooperatively, when the hinged portion is laid down on the front surface of the main body by the pivotal movement of the pivotal member, the insertion portion is also laid down on the back surface of the main body cooperatively, a housing section for housing the insertion portion is formed on the back surface of the main body, and in a state in which the hinged portion and the insertion portion are laid down, the insertion portion is made substantially flush with the back surface of the main body.

9. The golf ball marker according to claim 8, formed by die casting, wherein a magnetic member is embedded in the hinged portion, a suction face is formed in the step portion, a magnet being embedded on the back side of the suction face, and the hinged portion and the insertion portion are allowed to be kept in the laid-down state by having the magnetic member and the magnet attract each other with the suction face interposed therebetween.

10. The golf ball marker according to claim 9, used together with a clip having a suction plate made from a magnetic material and a hook capable of clipping clothes, wherein the golf ball marker is allowed to be held on the clip by having the magnet embedded in the back surface of the suction face and the suction plate attract each other.

11. The golf ball marker according to claim 8, wherein a step portion having a shape corresponding to the shape of the hinged portion is formed on the front surface of the main body;

a back surface of the step portion is configured as a part of the back surface of the main body; and in the state in which the hinged portion and the insertion portion are laid down, the hinged portion touches the stepped portion.

12. The golf ball marker according to claim 8, used together with a clip having a suction plate and a hook capable of clipping clothes, wherein the golf ball marker is allowed to be held on the clip by having the back surface of the main body and the suction plate attract each other.

* * * * *